US007814748B2

(12) United States Patent
Nydam et al.

(10) Patent No.: US 7,814,748 B2
(45) Date of Patent: Oct. 19, 2010

(54) EXHAUST BYPASS VALVE REMOTE LINKAGE

(75) Inventors: Kenneth Peter Nydam, Chatham (CA); David Thibault, Richmond Hill (CA)

(73) Assignee: Continental Automotive Canada, Inc., Chatham, Ontario (CA)

( * ) Notice: Subject to any disclaimer, the term of this patent is extended or adjusted under 35 U.S.C. 154(b) by 805 days.

(21) Appl. No.: 11/797,440

(22) Filed: May 3, 2007

(65) Prior Publication Data

US 2007/0261401 A1 Nov. 15, 2007

Related U.S. Application Data

(60) Provisional application No. 60/746,521, filed on May 5, 2006.

(51) Int. Cl.
*F01N 1/00* (2006.01)

(52) U.S. Cl. ..... 60/324; 60/274; 60/287; 60/292; 60/312; 60/322; 137/595; 137/601.01; 137/601.11; 137/601.17; 137/607

(58) Field of Classification Search ..... 60/274, 60/287, 288, 292, 312, 322, 323, 324; 137/595, 137/601.01, 601.11, 601.12, 601.17, 607, 137/862

See application file for complete search history.

(56) References Cited

U.S. PATENT DOCUMENTS

| | | | | |
|---|---|---|---|---|
| 3,992,879 | A * | 11/1976 | Miyamori et al. | 60/288 |
| 4,869,063 | A * | 9/1989 | Sakurai et al. | 60/313 |
| 4,939,898 | A * | 7/1990 | Ichimura et al. | 60/274 |
| 5,630,571 | A * | 5/1997 | Kipp et al. | 251/214 |
| 6,584,767 | B1 * | 7/2003 | Koenig | 60/288 |
| 6,655,134 | B2 * | 12/2003 | Nakayasu et al. | 60/324 |
| 6,739,579 | B1 * | 5/2004 | Rim | 251/306 |
| 7,121,088 | B2 * | 10/2006 | Lavin | 60/324 |
| 7,171,804 | B2 * | 2/2007 | Terashima | 60/323 |
| 2001/0027648 | A1 | 10/2001 | Nakayasu et al. | |

* cited by examiner

*Primary Examiner*—Binh Q. Tran

(57) ABSTRACT

An exhaust bypass valve assembly for an internal combustion engine includes an exhaust bypass valve having valve structure coupled to a rotatable shaft such that rotation of the shaft moves the valve structure between opened and closed positions. An actuator is disposed remotely from the bypass valve for selectively causing rotation of the shaft associated with the valve structure in opposing directions. Linkage structure is connected between the actuator and the shaft to transfer motion of actuator to the shaft.

12 Claims, 2 Drawing Sheets

EXHAUST BYPASS VALVE REMOTE LINKAGE

This application claims the benefit of the earlier filing date of U.S. Provisional Application No. 60/746,521, filed on May 5, 2006, which is incorporated by reference herein in its entirety.

FIELD OF THE INVENTION

This invention relates to an Exhaust Bypass Valve (EBV) for diesel engines and, more particularly, to a remote linkage for operating the EBV.

BACKGROUND OF THE INVENTION

A conventional EBV is mounted in with respect to an exhaust gas cooler of an exhaust manifold of a diesel engine. Depending on the engine operating mode, the EBV directs exhaust gas flow through the exhaust cooler or through a bypass channel. Since the EBV is mounted on the exhaust manifold, it encounters severe temperatures and vibration. The actuator used to drive butterfly plates of the EBV must be robust to achieve the performance requirements. Typically, high cost, high temperature actuators are employed.

Thus, there is a need to provide remote actuation of valve structure of an EBV whereby less expensive actuators can be used since they can be mounted remote from the exhaust manifold.

SUMMARY OF THE INVENTION

An object of the invention is to fulfill the need referred to above. In accordance with the principles of the present invention, this objective is achieved by providing an exhaust bypass valve assembly for an internal combustion engine. The assembly includes an exhaust bypass valve having valve structure coupled to a rotatable shaft such that rotation of the shaft moves the valve structure between opened and closed positions. An actuator is disposed remotely from the bypass valve for selectively causing rotation of the shaft associated with the valve structure in opposing directions. Linkage structure is connected between the actuator and the shaft to transfer motion of actuator to the shaft.

In accordance with another aspect of the invention, a method of remotely actuating an exhaust bypass valve for an internal combustion engine provides an exhaust bypass valve having at least one butterfly plate coupled to a rotatable shaft such that rotation of the shaft moves the butterfly plate between opened and closed positions. An actuator is mounted remotely from the bypass valve. The actuator is constructed and arranged to cause rotation of the shaft of the butterfly plate in opposing directions. A linkage structure is connected between the actuator and the shaft. The method includes actuating the butterfly plate by transferring motion of actuator to the shaft via the linkage structure.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, in which.

DETAILED DESCRIPTION OF THE EXEMPLARY EMBODIMENT

Figure 1:
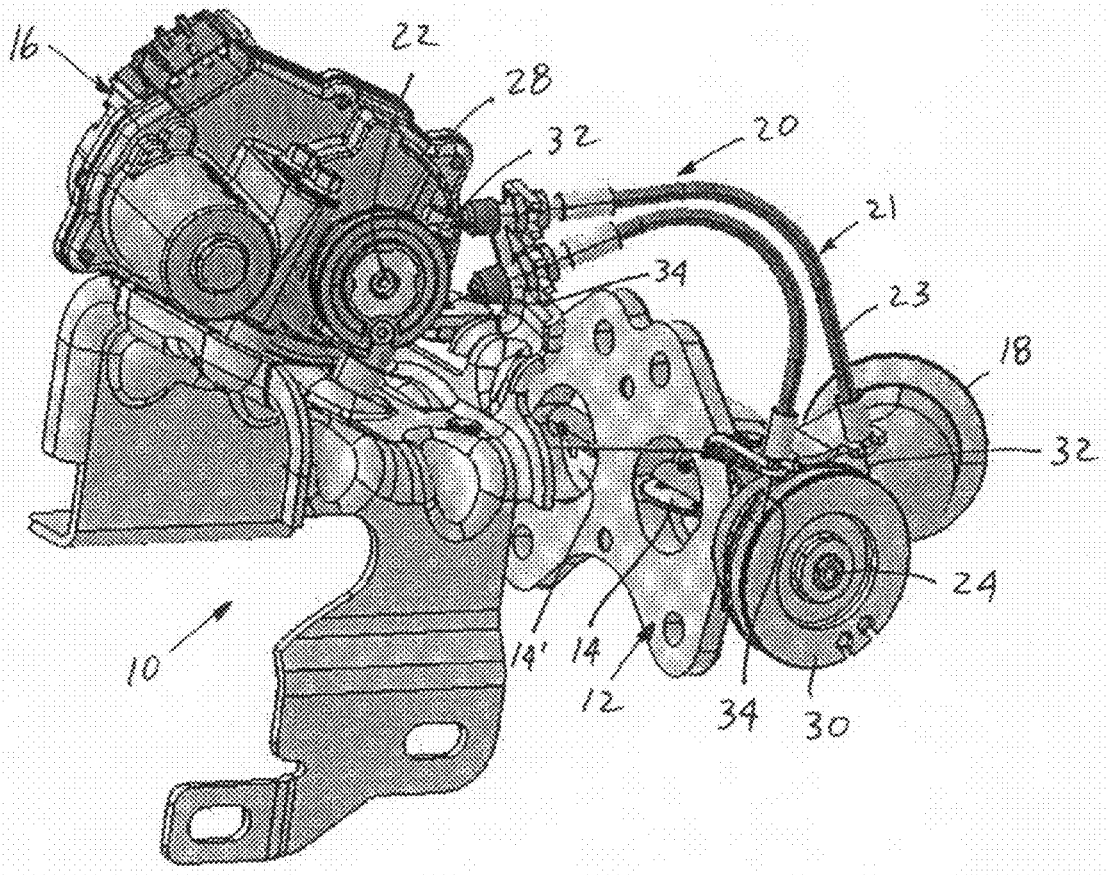
FIG. 1 is a perspective view of an EBV assembly including linkage structure provided in accordance with an embodiment of the present invention.

Referring to FIG. 1, an Exhaust Bypass Valve (EBV) assembly for a diesel engine is shown, generally indicated at 10, in accordance with an embodiment of the invention. The assembly 10 is constructed and arranged to be mounted with respect to an exhaust gas cooler of an exhaust manifold of, for example, a diesel engine (none of which are shown). For example, the assembly 10 can be mounted after the cooler such that exhaust gas enters from the back of an exhaust manifold into the cooler during a 'cooler' mode and bypasses the cooler during a 'hot' mode by using the external manifold as the bypass tube. The gas exits the exhaust manifold at the front, bypassing the cooler, entering directly into the assembly 10. The assembly 10 can be mounted before the cooler in certain configurations. The assembly is used in bypass mode during 1) cold start conditions to reduce the time it takes to bring the engine up to temperature by 'dumping' hot exhaust gas into the intake manifold and 2) DPF regeneration. In the cooler mode, the assembly 10 reduces exhaust gas recirculation temperature to increase air density and improve combustion and emissions.

The assembly 10 includes an EBV, generally indicated at 12, having the conventional pair of butterfly plates 14, 14' defining valve structure. A conventional motor-driven, general purpose actuator, generally indicated at 16, is provided to control operation of the butterfly plates 14, 14' to open and close a bypass passageway 18. In the embodiment, the actuator 16 is placed at a location remote from the EBV 12 so as to not be exposed directly to the high temperature and vibration that are associated with the exhaust manifold.

In the embodiment, the two butterfly plates 14, 14' are controlled by a single actuator 16. For example, the two butterfly plates 14, 14' are moved together on a single shaft 24 so as to utilize minimal packaging space, while enabling control of the two butterfly plates 14, 14' with one actuator 16.

In order to operate the butterfly plates 14, 14' with the remotely located actuator 16, linkage structure, generally indicated at 20, is provided. More particularly, the linkage structure 20 includes pulley and cable structure connected between the shaft 22 of the actuator 16 and a shaft 24 of the EBV 12 to radially close the butterfly plates 14, 14' onto a valve seat. Thus, the pulley and cable structure employs a Bowden cable, generally indicated at 21, having conventional sheathing 23, and employs pulleys 28 and 30. Since a Bowden cable can only be pulled and not pushed, a wrap around cable configuration is provided instead of providing two separate cables. The wrap around configuration, explained below, enables fast actuation in two directions. More particularly, a pulley 28 is coupled to the shaft 22 of the actuator 16 and a pulley 30 is coupled to the shaft 24 of the butterfly plates 14, 14'. The single Bowden cable 21 wraps partially around the pulley 30 and partiality around the pulley 28 to define a first cable portion 32 and a second cable portion 34.

Figure 2:
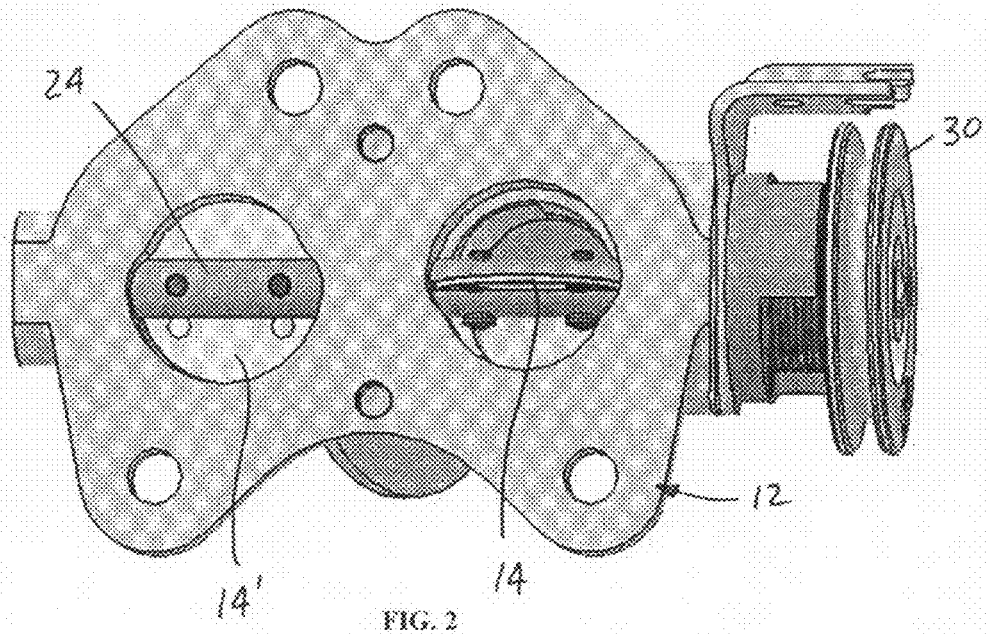
FIG. 2 is a view of the EBV of the assembly of FIG. 1 shown in a default position and without the linkage structure attached.

Rotation of the actuator shaft 22 in a first direction places one of the cable portions 32 or 34 in tension so as to rotate the shaft 24 and place the butterfly plates 14, 14' in a first position. For example, with reference to FIG. 2, the first position of the butterfly plates 14, 14" can be a default position where cool exhaust gas is directed to an exhaust gas recirculation (ERG) valve (not shown) and engine intake manifold to reduce engine combustion temperature thereby reducing the emission of nitrogen oxides (NOx). Thus, as shown, the butterfly plate 14 is opened and butterfly plate 14' is closed.

Figure 3:
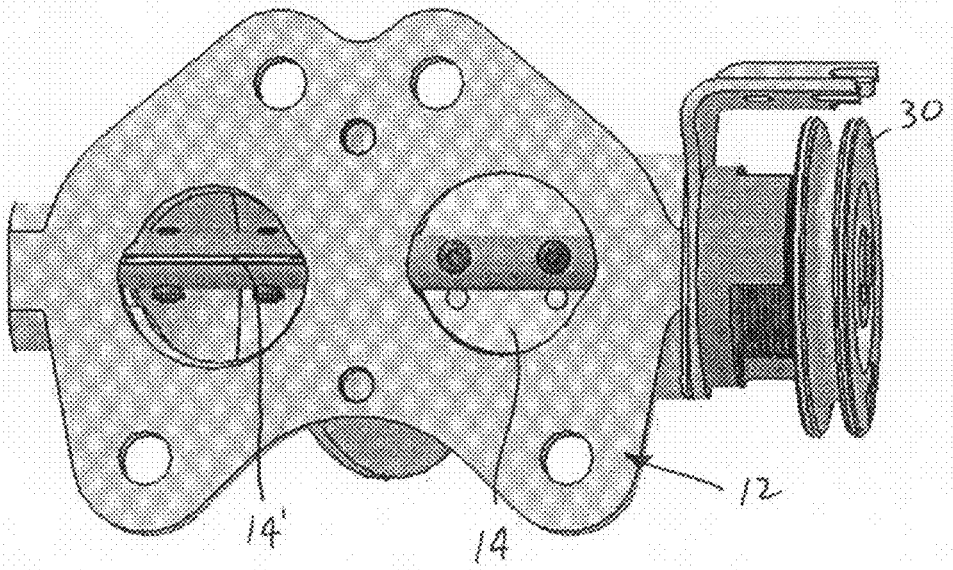
FIG. 3 is a view of the EBV of the assembly of FIG. 1 shown in a full travel position and without the linkage structure attached.

Rotation of the actuator shaft 22 in a direction opposite the first direction places the other cable portion in tension so as to rotate the shaft 24 and place the butterfly plates 14, 14' in a second position. For example, with reference to FIG. 3, the second position of the butterfly plates 14, 14" can be a full travel position where hot exhaust gas is directed to the EGR valve and intake manifold and exhaust system to regenerate a catalytic converter. Thus, as shown, the butterfly plate 14 is closed and butterfly plate 14' is opened. The actuator 16 selectively cycles the butterfly plates 14, 14' opened and closed depending on the engine's operating mode and requirements.

Thus, by using the linkage structure 20, the temperature and vibration sensitive actuator 16 can be mounted in an engine environment away from the harsh environment to achieve durability and the functional requirements. In addition, the remotely located actuator 16 and use of the linkage structure 20 enables optimization in packaging. For example, in a certain applications where the necessary space for the actuator 16 is not available at the EBV position, the actuator can be located elsewhere. Still further, since the actuator 16 is not located in the harsh environments, a use of less expensive actuators is possible.

The linkage structure 20 can be employed in a valve system that includes a single butterfly plate. In addition, instead of the wrap around configuration in the embodiment, the linkage structure 20 can employ two separate Bowden cables, one for moving the butterfly plates 14, 14' into the first position and the other for moving the butterfly plates 14, 14' to the second position via movement of the actuator 16. Furthermore, although butterfly plates 14 are disclosed as the valve structure of the bypass valve, the bypass valve can include any conventional valve structure configuration that can be actuated by a cable such as, a flapper valve, a slide valve, a poppet valve, and the like.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An exhaust bypass valve assembly for an internal combustion engine comprising:

an exhaust bypass valve having valve structure coupled to a rotatable shaft such that rotation of the shaft moves the valve structure between opened and closed positions, an actuator disposed remote from the bypass valve for selectively causing rotation of the shaft associated with the valve structure in opposing directions, and linkage structure connected between the actuator and the shaft to transfer motion of actuator to the shaft, wherein the linkage structure includes pulley and cable structure that comprises:

a first pulley coupled to a shaft of the actuator, a second pulley coupled to the shaft associated with the valve structure, and a single Bowden cable wrapped partially around each of the first and second pulleys such that rotation of the shaft of the actuator in a first direction causes the shaft associated with the valve structure to place the valve structure in a first position, and rotation of the shaft of the actuator in a direction opposite the first direction causes the shaft associated with the valve structure to place the valve structure in a second position.

2. The assembly of claim 1, wherein the valve structure comprises at least one butterfly plate.

3. The assembly of claim 2, wherein a pair of butterfly plates are provided on the shaft that are constructed and arranged such that when one butterfly plate is in the opened position, the other butterfly plate is in the closed position.

4. The assembly of claim 1, wherein valve structure includes a pair of butterfly plates provided on the shaft that are constructed and arranged such that when one butterfly plate is in the opened position, the other butterfly plate is in the closed position.

5. The assembly of claim 1, wherein the bypass valve is constructed and arranged to be mounted in front of an exhaust gas cooler of a diesel engine.

6. An exhaust bypass valve assembly for an internal combustion engine comprising:

an exhaust bypass valve having valve structure coupled to a rotatable shaft such that rotation of the shaft moves the valve structure between opened and closed positions, means, disposed remote from the bypass valve, for selectively causing rotation of the shaft associated with the valve structure in opposing directions, and means, connected between the means for causing rotation and the shaft, for transferring motion of the means for causing rotation to the shaft, wherein the means for transferring motion includes pulley and cable structure and the means for causing rotation is an actuator, the pulley and cable structure comprising:

a first pulley coupled to a shaft of the actuator, a second pulley coupled to the shaft associated with the valve structure, and a single Bowden cable wrapped partially around each of the first and second pulleys such that rotation of the shaft of the actuator in a first direction causes the shaft associated with the valve structure to place the valve structure in a first position, and rotation of the shaft of the actuator in a direction opposite the first direction causes the shaft associated with the valve structure to place the valve structure in a second position.

7. The assembly of claim 6, wherein the valve structure comprises at least one butterfly plate.

8. The assembly of claim 7, wherein a pair of butterfly plates are provided on the shaft that are constructed and arranged such that when one butterfly plate is in the opened position, the other butterfly plate is in the closed position.

9. The assembly of claim 6, wherein valve structure includes a pair of butterfly plates provided on the shaft that are constructed and arranged such that when one butterfly plate is in the opened position, the other butterfly plate is in the closed position.

10. The assembly of claim 6, wherein the bypass valve is constructed and arranged to be mounted in front of an exhaust gas cooler of a diesel engine.

11. A method of remotely actuating an exhaust bypass valve for an internal combustion engine, the method comprising:

providing an exhaust bypass valve having at least one butterfly plate coupled to a rotatable shaft such that rotation of the shaft moves the butterfly plate between opened and closed positions, mounting an actuator remote from the bypass valve, the actuator being constructed and arranged to cause rotation of the shaft of the butterfly plate in opposing directions, connecting a linkage structure between the actuator and the shaft, and actuating the butterfly plate by transferring motion of actuator to the shaft via the linkage structure, wherein the linkage structure comprises:

a first pulley coupled to a shaft of the actuator, a second pulley coupled to the shaft associated with the butterfly plate, and a single Bowden cable wrapped partially around each of the first and second pulleys such that rotation of the shaft of the actuator in a first direction causes the shaft associated with the butterfly plate to place the butterfly plate structure in a first position, and rotation of the shaft of the actuator in a direction opposite the first direction causes the shaft associated with the butterfly plate to place the butterfly plate in a second position.

12. The method of claim 11, wherein a pair of butterfly plates are provided on the shaft that are constructed and arranged such that when one butterfly plate is in the opened position, the other butterfly plate is in the closed position.

* * * * *